United States Patent [19]

Mead et al.

[11] 4,088,566

[45] May 9, 1978

[54] TRANSFORMER OIL PROCESSING

[75] Inventors: Theodore C. Mead, Port Neches; Norman R. Odell, Nederland, both of Tex.

[73] Assignee: Texaco Inc., New York, N.Y.

[21] Appl. No.: 811,336

[22] Filed: Jun. 29, 1977

[51] Int. Cl.[2] ..... C10G 27/04; C10G 23/00

[52] U.S. Cl. ..... 208/90; 208/3; 208/211; 208/254 H; 208/143

[58] Field of Search ..... 208/211, 208, 143, 90, 208/14, 3, 254 H

[56] References Cited

U.S. PATENT DOCUMENTS

| | | | |
|---|---|---|---|
| 2,865,849 | 12/1958 | van Loon et al. | 208/211 |
| 2,944,015 | 7/1960 | Rausch et al. | 208/211 |
| 2,973,315 | 2/1961 | Watson | 208/211 |
| 3,145,161 | 8/1964 | Anderson et al. | 208/14 |
| 3,341,448 | 9/1967 | Ford et al. | 208/211 |
| 3,502,567 | 3/1970 | Mills et al. | 208/14 |
| 3,681,233 | 8/1972 | Mills et al. | 208/14 |
| 3,830,730 | 8/1974 | Mead et al. | 208/211 |
| 3,953,319 | 4/1976 | Chesluk et al. | 208/14 |

*Primary Examiner*—George Crasanakis

*Attorney, Agent, or Firm*—Carl G. Ries; Thomas H. Whaley; Kenneth R. Priem

[57] ABSTRACT

A transformer oil processing sequence is disclosed which produces a superior oil without the use of large doses of sulfuric acid and the resultant sludge problems. The process comprises contacting a naphthenic based oil with an oxygen-containing gas in the presence of a catalytic amount of sulfuric acid under mild conditions of temperature and pressure and caustic washing the resultant product. The caustic washed product is then hydrogenated.

9 Claims, No Drawings

TRANSFORMER OIL PROCESSING

BACKGROUND OF THE INVENTION

1. Field of the Invention

This invention pertains to the field of processing transformer oils.

This invention relates to mineral oils used as electrical insultating oils as in transformer switches and the like and generally called transformer oils. More particularly, it relates to the use of a particular processing sequence beginning with the preoxidation of the mineral oil before further processing steps.

Oils used as electrical insulating oils in transformers or switches must be capable of resisting current conduction at voltage levels much higher than the voltages at which a transformer switch is normally operated since severe surges of voltage can occur in transformers and switches exposed to systemic disturbances such as lightning. This property of an insulating oil is termed its impulse strength. In addition, these oils must have an inherent resistance to oxidative processes which break down such oils and make then unfit for their intended purpose. With additive oxidation inhibitors they should show a substantial increase in oxidative resistance over their inherent oxidative resistance.

Heretofore insulating oils with acceptable properties have been produced by various methods which usually included treating with large doses of sulfuric acid. However, large doses of sulfuric acid are not preferred since it produces large amounts of sludge which must be disposed of. Environmental considerations demand that processes be developed which reduce or eliminate this sludge problem. In the present invention, a preoxidation step using a small amount of sulfuric acid as catalyst is used which when used in combination with the other steps produces an oil having superior properties necessary for insulating oils and resulting in substantially less sludge. U.S. Pat. No. 3,725,253 discloses a process for the purification of lubricating oils which comprises first reacting the mineral oil with an oxygen containing gas catalytically at temperatures ranging from 226° F to 536° F in the presence of 2.5% sulfuric acid. This severe process results in the destruction of a large percentage of the incoming charge stock resulting in a very large amount of sludge. Thus, vacuum distillation is required to remove the compounds produced in the oxidation step. The process of the patent is completely different from the process of the present invention since the preoxidation step in the present invention is carried out at a much lower temperature resulting in almost no impurity generation. As a consequence, vacuum distillation is not required at the end of the oxidation step in the present process. Thus, it is clear that the patent is directed to a completely different process which has as its aim a completely different objective and achieves different results than this invention.

U.S. Pat. No. 3,105,812 describes a process for removing nitrogen-containing compounds from cracking and hydrocracking feed stocks by catalytic oxidation followed by hydrogenation. The oxidation is catalyzed by phosphorous oxide or a phosphorous oxide and vanadium oxide mixture. As the patent points out, the vanadium oxide catalyst, which is a relatively well known oxidation catalyst, is not very effective used alone. Although the claims of the patent include a temperature between 100° and 600° F for the oxidation step, the examples given in the patent were carried out at from 300° to 400° F. It has been found in using the process of our invention that oxidation of transformer oil stocks can be carried out at a much lower temperature rountinely. This is surprising in view of the data in U.S. Pat. No. 3,105,812. At column 10, lines 51–59 the patent teaches that a charge stock boiling in the range of a typical transformer oil distillate (550°–750° F) is best hydrogenated at 800–1600 psi. Using the process of our invention, the hydrogenation pressure is much lower.

The invention to be disclosed below uses a unique catalyst system for preoxidizing a transformer oil feed stock at very mild conditions. The fact that this can be done is surprising in view of the prior art which teaches oxidation of hydrocarbon oil feed stocks at much more severe conditions. The mild conditions to be delineated below have very real advantages in fuel savings, required metallurgy, and capital investment as well as other considerations.

SUMMARY OF THE INVENTION

This invention comprises first treating a suitable naphthenic transformer oil charge stock by catalytic oxidation at a temperature below about 275° F and at pressure ranging up to about 300 psi in the presence of a catalytic quantity of sulfuric acid, second contacting the oil with an aqueous solution of a base and thirdly, contacting the oil with hydrogen in the presence of a hydrogenation catalyst at a temperature of from about 400° to 675° F and at a pressure from about 10 to 400 psi at a space velocity ranging from 0.1 to 10.0 vol/vol/hr.

DESCRIPTION OF THE PREFERRED EMBODIMENTS

Examples of suitable hydrocarbon oil charge stocks for the process of this invention are those naphthenic distillates which typically boil in the range of 250° to 400° C and have viscosities in the range of 40 to 100 SUS, preferably 50 to 60 SUS at 100° F. It is also possible to obtain transformer oils from distillates with viscosities as low as 30 and as high as 150 SUS at 100° F. The transformer oil stock are initally obtained from the distillation of crude naphthenic petroleum. The stock may be obtained as overhead from a vacuum distillation or may be obtained from the residue of vacuum distillation by deasphalting the residue by contact, for example, with a deasphalting agent such as propane, butane and the like or mixtures thereof.

Preoxidation

There are present in unprocessed lubricating oils molecular structural types which are particularly susceptible to oxidation and thermal and chemical degradation. These types include olefins, nitrogenous compounds, other compounds containing heteroatoms, certain types of aromatics and others. If allowed to remain in transformer oils, oxidation products of these species are polar or acidic in nature and tend to degrade the electrical insulating properties of transformer oils. Sulfuric acid treating has in the past removed such oxidizable species. This invention will show that other vigorously oxidizing conditions, in which oxidizing gases are the primary oxidants, can oxidize susceptible molecular types. The oxidates thus formed can then be removed or rendered innocuous by other processing steps to be pointed out herebelow.

The oxidation step is carried out catalytically with sulfuric acid being the preferred catalyst. Operable concentration range of the catalyst is from 0.1 to 2.0 weight percent basis oil. The preferred range is from 0.1 to 1.0 weight percent basis oil.

The temperature at which the oxidation step should be performed is from 150° to 200° F. The preferred range is from about 160° to 180° F. This temperature may vary depending on the rate at which air is fed into the reactant mixture. However, the oxidation temperature is a function of the exothermic temperature of the reaction and generally does not require external heating. It is preferred to adjust the air dosage rates so that the heat generated by the oxidation is just sufficient to maintain the required mild reaction temperature.

The operable pressure for the oxidation reaction is up to about 300 psi. It is preferred to operate at about atmospheric pressure if possible. The dosage rate of oxidizing gas is from about 0.01 to 5.0 SCF per minute per kilogram of oil. However, this dosage rate will depend on the concentration of inert diluent in the oxidizing gas, and the desired operating temperature as well as other operating variables. It is preferred to use from about 0.01 to 3.0 SCF per minute per kilogram of oil when possible.

The oxidizing gas may be chosen from the group consisting of air, oxygen, ozone, oxides of nitrogen and combinations of these with addition of inert diluents such as nitrogen. It is preferred to use air and oxygen-nitrogen mixtures whenever possible.

Caustic Washing

Caustic washing is the intimate contact of an aqueous solution of caustic (basic) material with the oil. Caustic washing may be accomplished with sodium hydroxide, sodium carbonate, soda ash, potash or similar bases as reageants. The procedures of caustic washing are well known and need not be discussed further.

Hydrogenation

Catalytic hydrogenation (hydrorefining) is performed at a temperature between at about 400° F to 675° F, preferentially between about 550° to 600° F under a hydrogen pressure between about 15 to 400 psi preferably between about 300 and 350 psi, utilizing a hourly space velocity (v/v/hr) of between about 0.1 to 10 volumes of oil per volume of catalyst per hour, preferably between about 0.5 to 1.5 vol/vol/hr with a hydrogen dosage of between about 50 and 500 standard cubic feet per barrel (scfb), preferably between about 200 and 400 scfb. The hydrogen gas used for the hydrogenation step need not necessarily be a pure hydrogen, hydrogen having a purity of at least about 65 volume percent preferably about 75 volume percent may be employed.

The catalyst employed in the hydrogenation step generally comprises a hydrogenation component on a support. The principal ingredient of the hydrogenation component is a Group VIII metal or mixtures of Group VIII metals or compounds thereof such as the oxides or sulfides. Examples of Group VIII metals which may be used in the hydrogenating compound are a nickel, cobalt or iron or mixtures thereof. The Group VIII metal should be present in an amount between about 2 and 10 weight percent, preferably between about 5 and 6 weight percent calculated as the metal oxide based on the total weight of the catalyst composite. In conjunction with the Group VIII metal, a Group VI metal such as molybdenum or tungsten may be used. In such case, the Group VI metal may be present in an amount between about 10 and 30 weight percent calculated as the metal oxide based on the weight of the composite, a preferred range being about 12 and 15 weight percent.

The hydrogenating catalyst component is carried on a base comprising a refractory inorganic oxide material such as alumina, silica, magnesia, zirconia, titania, crystalline alumino silicates and the like and mixtures thereof.

EXPERIMENTAL

A 55 second (at 100 F) naphthene pale oil (135 pounds) in admixture with sulfuric acid (0.35 lb) was blown with air at a rate of 4.0 SCFM; temperature was raised to 165° F and maintained at that temperature for 6 hours. The oxidized solution was cooled and 880 ml distilled water were added to aid coagulation of sludge. Oxidized oil (130.1 lbs) was decanted from sludge and water and neutralized with 3760 ml 15° Be soda ash; it was water washed until neutral and purged with nitrogen for 1 hour to remove water.

The clear, bright oxidate was hydrogenated at 610° F at 300 psi hydrogen at a LHSV of 0.6 over American Cyanamid HDS-3A; a commercial nickel-molybdenum on alumina hydrogenation catalyst. A hydrogen dosage of 400 SCFB was used.

Electrical properties of the product oil are compared, below, with specifications for a typical current acid-treated transformer oil six ASTM test results are included:

| Test | ASTM D- | Product Oil | Commercial Acid Treated Oil | |
|---|---|---|---|---|
| Neutralization number | 974 | 0.02 | 0.02 | max |
| Dielectric strength, kv | 877 | 31 | 30 | min |
| Dielectric strength, kv | 1816 | 20.5 | 20 | min |
| Power Factor, 60 cycles | 924 | | | |
| 25 C, 10v/mil | | 0.03 | 0.05 | max |
| 100 C, 10v/mil | | 0.17 | 0.30 | max |
| Resistivity, ohm-cm | 1169 | | | |
| 25 C, 10v/mil, $\times 10^{12}$ | | 441 | 70 | min |
| 100 C, 10v/mil, $\times 10^{12}$ | | 32 | 30 | min |
| Color, ASTM | 1500 | < 0.5 | 0.5 | max |

Employing the method of U.S. Pat. No. 3,749,666 in which the oxidation was carried out at 250° F in the presence of 2.5 wt% sulfuric acid resulted in the formation of 7 pounds of acid sludge from 136.2 pounds of 55 second naphthenic distillate charge. In the method of this invention (as shown above) the same charge was oxidized unexpectedly, without measurable sludge formation.

We claim:

1. A method of making transformer oils comprising (a) contacting a naphthene oil with an oxygen-containing gas selected from the group consisting of air, oxygen, ozone, oxides of nitrogen, and mixtures thereof, and with a catalytic amount of sulfuric acid at a temperature from about 150° to 200° F and a pressure ranging up to about 300 psi, (b) contacting the oil from (a) with an aqueous solution of a base to wash out oxidates formed in step (a), (c) contacting the oil from step (b) with hydrogen and with a hydrogenation catalyst at a temperature of from about 400° to 675° F at a pressure of from about 15 to 400 psi at a space velocity ranging from 0.1 to 10.0 vol/vol/hr with a hydrogen dosage from about 50 and 500 scfb, and (d) separating a transformer oil product from step (c).

2. A method as in claim 1 wherein the oxygen-containing gas is air.

3. A method as in claim 1 wherein the temperature in step (a) is from 160° to 180° F.

4. A method as in claim 1 wherein the amount of sulfuric acid is from 0.1 to 2.0 weight percent basis oil.

5. A method as in claim 1 wherein the temperature in step (c) is from about 550° to 600° F.

6. A method as in claim 1 wherein the pressure in step (c) is from about 300 to 400 psi.

7. A method as in claim 1 wherein the space velocity in step (c) is from about 0.5 to 1.5 vol/vol/hr.

8. A method as in claim 1 wherein the hydrogen dosage is from about 200 to 400 scfb.

9. A method of making transformer oils comprising (a) contacting a naphthene oil with air and with a catalytic amount of sulfuric acid ranging from about 0.1 to 1.0 weight percent basis oil at a temperature of from about 160° to 180° F and at a pressure ranging from atmospheric to 300 psi, (b) contacting the oil from (a) with an aqueous solution of a base to wash out oxidates formed in step (a), (c) contacting the oil from step (b) with hydrogen and with a hydrogenation catalyst at a temperature of from about 550° to 600° F at a pressure of from about 300 to 400 psi at a space velocity ranging from 0.5 to 1.5 vol/vol/hr with a hydrogen dosage from about 200 to 400 scfb, and (d) separating a transformer oil product from step (c).

* * * * *